US007435287B2

(12) United States Patent
Holmes et al.

(10) Patent No.: US 7,435,287 B2
(45) Date of Patent: Oct. 14, 2008

(54) AIR CLEANER HAVING SEPARATE MODULES FOR COLLECTOR PLATES AND IONIZING WIRES

(75) Inventors: Gordon Holmes, St. Louis, MO (US); Damon Drumm, St. Louis, MO (US); John M. Sartain, St. Louis, MO (US)

(73) Assignee: Emerson Electric Co., St. Louis, MO (US)

( * ) Notice: Subject to any disclaimer, the term of this patent is extended or adjusted under 35 U.S.C. 154(b) by 47 days.

(21) Appl. No.: 11/636,120

(22) Filed: Dec. 8, 2006

(65) Prior Publication Data

US 2008/0134896 A1 Jun. 12, 2008

(51) Int. Cl.
*B03C 3/72* (2006.01)

(52) U.S. Cl. ..... 96/18; 95/2; 95/3; 96/19; 96/25; 96/26; 96/30; 96/31; 96/39

(58) Field of Classification Search ..... 96/18, 96/19, 26, 30, 31, 39–41, 96, 25; 95/2, 3, 95/25

See application file for complete search history.

(56) References Cited

U.S. PATENT DOCUMENTS

| | | | | | |
|---|---|---|---|---|---|
| 3,740,926 | A * | 6/1973 | Duval | 96/26 |
| 4,284,420 | A * | 8/1981 | Borysiak | 96/40 |
| 4,645,970 | A | 2/1987 | Murphy | 313/509 |
| 5,035,728 | A * | 7/1991 | Fang | 96/19 |
| 5,181,883 | A * | 1/1993 | Hofstra et al. | 454/49 |
| 5,290,343 | A * | 3/1994 | Morita et al. | 96/39 |
| 5,628,818 | A * | 5/1997 | Smith et al. | 96/30 |
| 5,674,381 | A | 10/1997 | Den Dekker | 210/85 |
| 5,759,487 | A * | 6/1998 | Jung | 422/22 |
| 6,126,727 | A * | 10/2000 | Lo | 96/39 |
| 6,203,276 | B1 | 3/2001 | Lasko et al. | 416/61 |
| 6,576,046 | B2 * | 6/2003 | Pruette et al. | 96/26 |
| 6,616,736 | B2 * | 9/2003 | Massey et al. | 96/25 |
| 6,679,940 | B1 | 1/2004 | Oda | 96/55 |
| 6,899,745 | B2 * | 5/2005 | Gatchell et al. | 95/76 |
| 7,244,289 | B2 * | 7/2007 | Su | 96/39 |
| 2004/0083896 | A1 * | 5/2004 | Mihaylov et al. | 96/414 |
| 2005/0178265 | A1 * | 8/2005 | Altman et al. | 95/2 |
| 2006/0162564 | A1 * | 7/2006 | Paterson et al. | 96/55 |

* cited by examiner

*Primary Examiner*—Richard L Chiesa
(74) *Attorney, Agent, or Firm*—Harness, Dickey & Pierce, P.L.C.

(57) ABSTRACT

An air cleaner is provided that includes one or more ionizing panels having at least one ionizing wire in connection with a voltage source. One or more collector cells separate from the one or more ionizing wire panels are releasably received within the air cleaner housing to establish an electrical connection between the collector cell and the voltage source for applying a voltage potential between the collector cell and the ionizing wire. The collector cell may be removed from the air cleaner to permit cleaning of the collector cell separate from the ionizing panels. The air cleaner monitors at least one variable indicative of the operation of the air cleaner. Upon determining that the variable has reached a predetermined level indicative of a significant amount of dust accumulation, a controller activates a light source to illuminate indicia on a display screen which indicates a need for servicing the air cleaner.

19 Claims, 2 Drawing Sheets

AIR CLEANER HAVING SEPARATE MODULES FOR COLLECTOR PLATES AND IONIZING WIRES

FIELD

Figure 1:
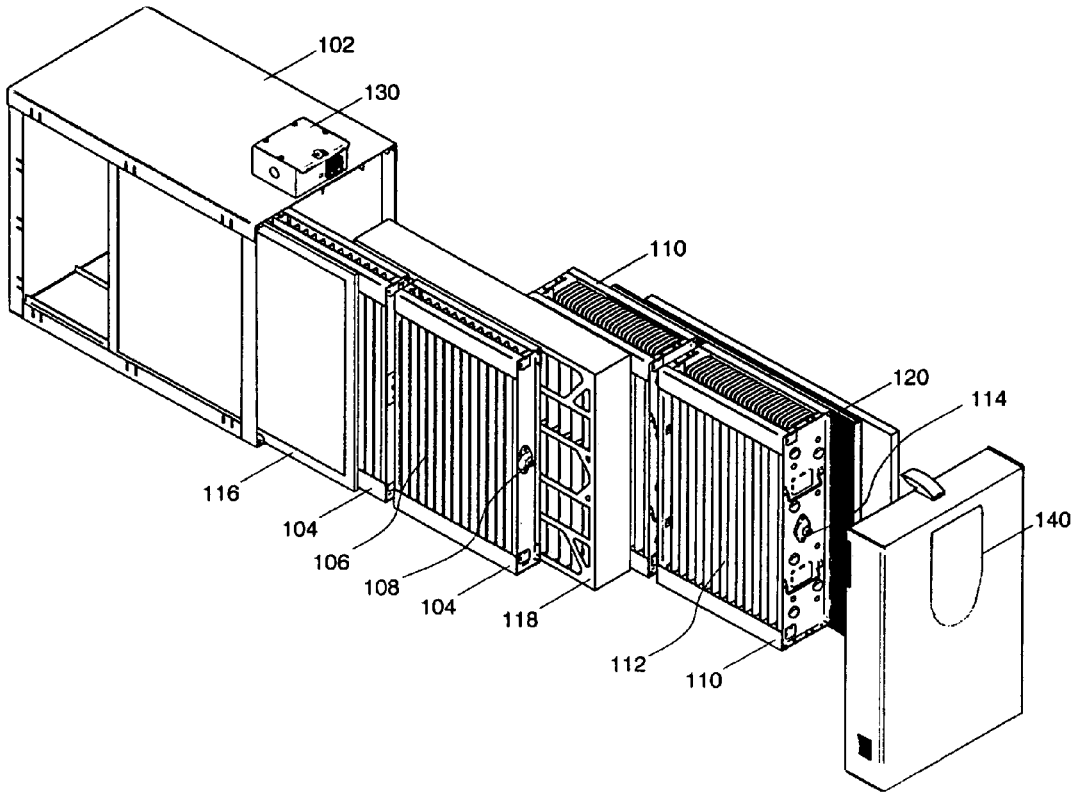

The present disclosure relates to an air cleaner, and more particularly, to an air cleaner adapted to charge dust particles suspended in air using an ionizing wire and a collector cell.

BACKGROUND

The statements in this section merely provide background information related to the present disclosure and may not constitute prior art.

Electrostatic air cleaners that charge and capture dust particles in the air include an ionization unit having an ionizing wire or wires (a discharge section) for charging the dust particles, and an opposite electrode comprising collector plates. The space between the collector plates and ionizing wires provides a path through which dust particles in the air passing between the ionizing wires and the collector plates are charged. In the air cleaner of this type, the ionization unit must be periodically cleaned or replaced in order to maintain adequate dust collection by the air cleaner.

SUMMARY

In one embodiment, an electrostatic air cleaner is provided that comprises one or more ionizing cell panels having at least one ionizing wire in connection with a voltage source, and one or more collector cell panels. The one or more ionizing cell panels are releasably received within the air cleaner housing in such a manner that an electrical connection is established between the at least one ionizing wire and the voltage source. The one or more collector cells have one or more collector plates, and are separate from the one or more ionizing wire panels. The one or more collector cells are releasably received within the air cleaner housing in such a manner that an electrical connection is established between the one or more collector plates and the voltage source, to permit application of a voltage potential between the one or more collector plates and the one or more ionizing wire. The one or more collector cells are also releasably received within the air cleaner housing for allowing the removal of the cell to permit cleaning of the cell separately from the ionizing wire panels. The electrostatic air cleaner further comprises a light source, and a display screen for covering the light source that is translucent to permit at least a portion of the light emitted by the light source to pass through the display screen. The display screen further includes indicia on the screen through which light does not pass through. A control means is provided monitoring the level of dust and dirt accumulation in the air cleaner. When the controller detects a predetermined value indicative of a significant amount of dust accumulation, the air cleaner activates the light source to illuminate the screen such that the indicia is visible. The indicia indicates the one or more collector cells requires cleaning, and may further include the contact information of a contractor for requesting service of the air cleaner.

In various embodiments of an electrostatic air cleaner, an electrostatic air cleaner is provided that comprises an ionizing cell panel having at least one ionizing wire in connection with a voltage source, and at least one collector panel. The ionizing cell panel is releasably received within the air cleaner housing in such a manner that an electrical connection is established between the at least one ionizing wire and the voltage source. The collector cell has one or more collector plates, and is separate from the ionizing wire panel. The collector cell is releasably received within the air cleaner housing in such a manner that an electrical connection is established between the one or more collector plates and the voltage source, to permit application of a voltage potential between the one or more collector plates and the at least one ionizing wire. The collector cell is also releasably received within the air cleaner housing for allowing the removal of the cell to permit cleaning of the cell separately from the ionizing wire panel. The electrostatic air cleaner further comprises a light source, and a display screen for covering the light source that is translucent to permit at least a portion of the light emitted by the light source to pass through the display screen. The display screen further includes indicia on the screen through which light does not pass through. A controller is provided for initiating air cleaner operation upon the introduction of air flow through the air cleaner, and for monitoring the operation and number of cycles of the air cleaner. The controller is configured to activate the light source to illuminate the screen such that the indicia is visible to alert a user of a need for servicing based on the controller's monitoring of the operation and number of cycles of the air cleaner. The indicia may indicate the existence of a problem requiring servicing, or the need for cleaning, and may further include the contact information of a contractor for requesting service of the air cleaner.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

Figure 2:
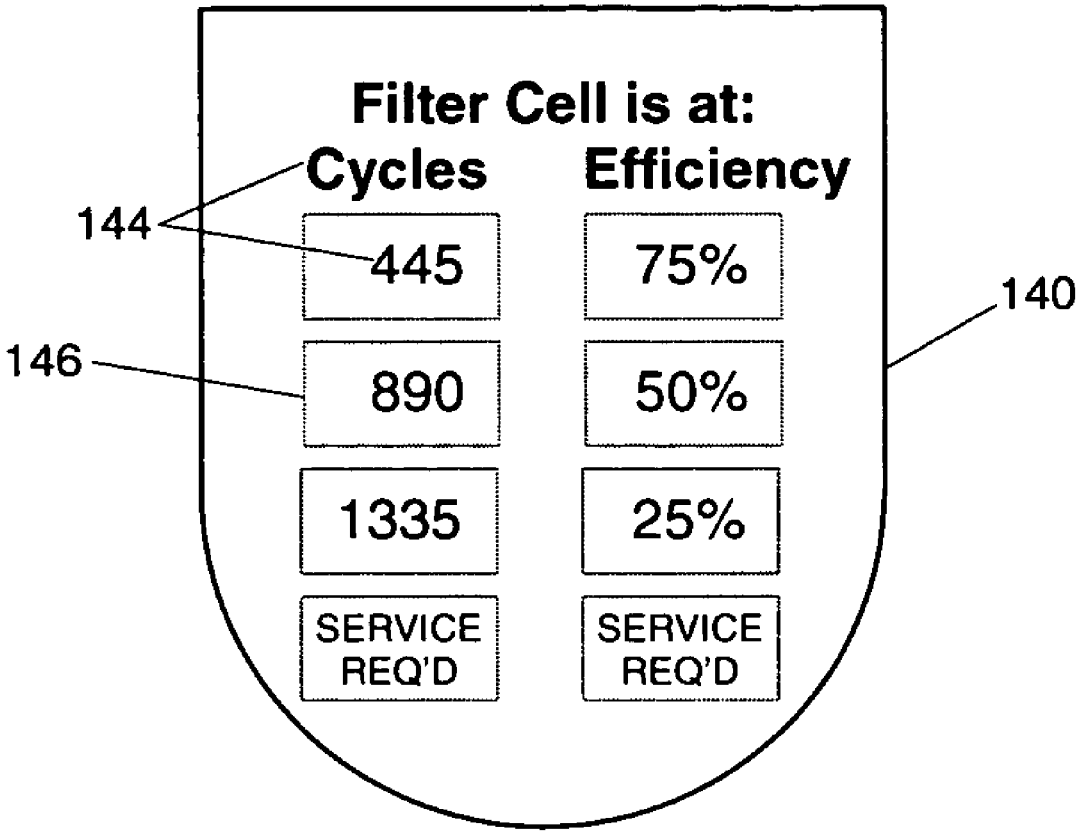

FIG. 1 is an exploded perspective view of one embodiment of an electrostatic air cleaner in accordance with the principles of the present invention; and FIG. 2 is one embodiment of a display screen for an electrostatic air cleaner in accordance with the principles of the present invention.

DETAILED DESCRIPTION

The following description is merely exemplary in nature and is not intended to limit the present disclosure, application, or uses.

The present disclosure relates to an improved design for electrostatic air cleaners, which provides notice for required cleaning and for improved means of cleaning of the air cleaner. In one embodiment shown in FIG. 1, the electrostatic air cleaner generally comprises an enclosure or housing 102 for receiving at least one ionizer cell panel 104, and at least one collector cell 110 therein. The air cleaner may further include one or more of a pre-filter 116, a media filter 118, or a charcoal filter 120, which may be received within the housing 102.

In the first embodiment, the at least one ionizing panel 104 comprises two ionizing panels, each having at least one ionizing wire 106 in connection with a voltage source (not shown). The ionizing panels 104 are releasably received within the air cleaner housing 102 in such a manner that an electrical connection 108 is established between the at least one ionizing wire 106 of the ionizing panel 104 and the voltage source. In the first embodiment, the ionizing wire 106 comprises a single wire that is weaved in a serpentine pattern around a plurality of hook supports on opposing sides of the ionizing cell panel 104, to provide a plurality of spaced apart ionizing wire sections. It should be noted that individual ionizing wires may alternatively be assembled within the ionizing panel rather than using a single serpentine ionizing wire 106. In the first embodiment, the single serpentine ionizing wire provides at least twelve spaced apart wire sections within the ionizing cell panel, which significantly reduces the number of ionizing wire components and replacement parts for the air cleaner.

The at least one collector cell in the first embodiment comprises two collector cells that may be releasably received within the housing 102. The collector cells 110 have one or more collector plates 112, where each cell is separate from the ionizing wire panels 104. The collector cell 110 is releasably received within the air cleaner housing 102 in such a manner that an electrical connection 114 is established between the one or more collector plates 112 and the voltage source to permit application of a voltage potential between the one or more collector plates 112 and the at least one ionizing wire 106 of the ionizing cell panel 104. The collector cell 110 is releasably received within the air cleaner housing 102 for allowing the removal of the collector cell 110 to permit cleaning of the collector plates and the collector cell separately from the ionizing wire cell panel 104. This provides the advantage of allowing cleaning of the collector cell 110 without risking harm to the ionizing wire 106 that may be damaged once removed.

In the first embodiment, the air cleaner further comprises controller 130 for monitoring the operation of the air cleaner. When the air cleaner detects the introduction of air flow through the air cleaner, such as when airflow is established by a furnace, air conditioner or air handler unit that the air cleaner is in connection with, the controller controls the application of a high voltage source to operate the air cleaner 100. The controller 130 controls the application of a voltage source to both the at least one ionizing wire 106 of the ionizing panel 104, and the one or more collector plates 112 in the collector cell 110, such that a voltage potential is established between the at least one ionizing wire 106 and the one or more collector plates 112. The at least one ionizing wire 106 and the one or more collector plates 112 are spaced apart such that the spacing provides a path through which dust particles in the air passing between the ionizing wire 106 and the collector plates 112 are charged. The charged particles in the air flow then are captured by the collector plates 110 within the collector cell 110.

The controller 130 may further comprise a control means for monitoring the extent to which the collector cell 110 is collecting charged dust particles, to evaluate the need for cleaning of the collector cell 110. The control means for monitoring the extent to which the collector plates are collecting particles may comprise measuring the electrical resistance, or ionizing current, through the collector plates resulting from the voltage applied, or monitoring the pressure drop of the air cleaner. In the first embodiment, the controller 130 includes a control means for monitoring the number of times the controller 130 connects the voltage source to the ionizing circuit to initiate operation of the air cleaner 100. The control means may comprise a counter device, or an Electronically Erasable Programmable Read Only Memory (EEPROM) that is incremented every time the controller 130 operates the air cleaner 100. The control means may also comprise a software program included in a microprocessor (not shown) for controlling the controller 130, which microprocessor would be able to track the number of on-cycles or number of times the air cleaner is operated. Likewise, the microprocessor may comprise its own EEPROM memory for storing the number of on-cycles or operations of the air cleaner. Based on a predetermined number of on-cycles that has been determined to represent a reduced efficiency in operation of the air cleaner as a result of dust build-up on the one or more collector cells 110, the controller may predict a need for cleaning the one or more air cleaner cells and alert the user of the air cleaner of a need for service or cleaning.

Alternatively, the control means may comprise a resistivity or current sensing device for sensing the buildup of dust on the collector plates which affects the resulting current through the ionizing circuit in connection with the voltage source. The control means may further comprise a pressure sensing device for sensing the build up of dust on the one or more collector plates, for evaluating when the air cleaner is in need of cleaning.

Once the control means has detected the current through the ionizing circuit, the air pressure drop across the air cleaner, or the number of on-cycles of the air cleaner (or any other suitable monitoring means), the control means may provide an output that may be used to establish a need for serving. The control means may provide an output to the controller 130 to activate a signal for alerting a user of a need for servicing or cleaning, when the number of on-cycles reaches a predetermined number of cycles that precedes a significant reduction in air cleaner operation. The air cleaner may operate, for example, up to 1780 cycles of operation before the air cleaner experiences a significant accumulation of dust, or a reduction in operating efficiency. Accordingly, the control means may provide an output when the on-cycle count reaches a predetermined percentage of this known number, such as 75 percent, or a predetermined number such as 1,335 cycles, for example. Alternatively, the control means may communicate an output of just the number of on-cycles, or the ionizing current value, or the pressure drop, to the microprocessor controlling the operation of the controller 130. The controller 130 would then be able to similarly monitor the number of on-cycles, or other parameters, to activate a signal for alerting a user of a need for servicing or cleaning before the air cleaner reaches a known number of cycles (or ionizing current level) at which the air cleaner has accumulated a significant amount of dust and particles.

In the first embodiment, the controller 130 preferably includes a control means for monitoring the accumulation of dust by monitoring the number of on-cycles or times the air cleaner is operated. Upon determining that the number of on-cycles is within a predetermined percentage of the number of cycles indicative of a need for cleaning the collector cells, the controller 130 activate a signal for alerting a user of a need for servicing or cleaning. For example, where a controller 130 has determined that the air cleaner has operated for 1,335 on-cycles (or 75 percent of a predetermined value of 1,780 known to be indicative of a need for cleaning of the collector cell), the controller 130 may activate a signal for illuminating an indicia that alerts the user that the collector cells 110 are at 25 percent of the 1,780 cycles remaining before the collector cells 110 require cleaning. This would provide a prediction of cleaning service, or sufficient warning to the user of the air cleaner to arrange for servicing or cleaning of the air cleaner collector cells 110.

Referring to FIG. 2, the air cleaner 100 further comprises a display screen 140 in communication with the controller 130. In the first embodiment, when the controller 130 predicts a need for cleaning of the collector plates, the controller provides a voltage signal to at least one light source (not shown) for illuminating portions, such as 146, of a screen. The at least one light source preferably comprises an electroluminescent lighting device for illuminating the screen when an electrical voltage is applied to the electroluminescent lighting. Alternatively, the at least one light source may further comprise a light emitting diode in communication with a reflective surface or a light pipe for directing light emitted from the diode to the display screen 140. The display screen 140 covers the at least one light source, and is translucent to permit at least a portion of the light emitted by the light source to pass through the screen 140. The display screen 140 further comprises indicia 144 on the screen through which light does not pass through. Upon determining or predicting a need for cleaning the collector cells 110, the controller 130 of the air cleaner 100 activates at least one light source to illuminate the display screen 140 such that the indicia is visible to a user for alerting the user of the current extent to which the collector plates are collecting particles, as well as a need for cleaning the collector cells.

In the first embodiment, the air cleaner 100 comprises a control means for monitoring the accumulation of dust in the air cleaner, where upon determining a predetermined amount of dust accumulation or remaining capacity for accumulation of less than 25 percent (based on the number of on-cycles, or measured current through the collector plates, for example), the air cleaner activates at least one light source to selectively illuminate the screen such that the indicia is visible to a user to alert the user of a need for servicing. The indicia may indicate the air cleaner or one or more collector cells require cleaning through the select illumination via a light source of an appropriate text message or an illustrative depiction of the collector cell being removed for cleaning.

In the first embodiment, the controller 130 is further capable of detecting the presence or absence of a voltage potential across the ionizing wire and collector cells once the controller 130 has initiating air cleaner operation after detecting air flow through the air cleaner. The controller 130 controls the application of a voltage source to the ionizing cell 104, and is capable of sensing the minimal voltage or absence of a voltage potential across the ionizing circuit that is indicative of a problem with the air cleaner. The controller 130 is further configured to activate a signal to illuminate a light source (or a second portion of an electroluminescent device) for illuminating indicia that provides an indication of a problem with the air cleaner. Accordingly, the controller 130 of the air cleaner is configured to alert a user of the problem with the air cleaner.

In various embodiments of an electrostatic air cleaner, an electrostatic air cleaner is provided that comprises an ionizing cell panel having at least one ionizing wire in connection with a voltage source, and at least one collector panel. The ionizing cell panel is releasably received within the air cleaner housing in such a manner that an electrical connection is established between the at least one ionizing wire and the voltage source. The collector cell has one or more collector plates, and is separate from the ionizing wire panel. The collector cell is releasably received within the air cleaner housing in such a manner that an electrical connection is established between the one or more collector plates and the voltage source, to permit application of a voltage potential between the one or more collector plates and the at least one ionizing wire. The collector cell is also releasably received within the air cleaner housing for allowing the removal of the cell to permit cleaning of the cell separately from the ionizing wire panel. The electrostatic air cleaner further comprises a light source, and a display screen for covering the light source that is translucent to permit at least a portion of the light emitted by the light source to pass through the display screen. The display screen further includes indicia on the screen through which light does not pass through. A control means is provided for initiating air cleaner operation upon the introduction of air flow through the air cleaner, and for monitoring the number of cycles of operation of the air cleaner. When the controller has determined that a predetermined number of cycles has transpired, the air cleaner activates the light source to illuminate the screen such that the indicia is visible. In one or more embodiments, the indicia indicates the collector cell requires cleaning, and may further include the contact information of a contractor for requesting service of the air cleaner.

In other embodiments of an electrostatic air cleaner, the controller is further capable of detecting the presence or absence of a voltage potential across the ionizing wire and collector cells, which is indicative of a problem with the air cleaner. Accordingly, the controller 130 is further configured to activate a signal to illuminate a light source for illuminating indicia that provides an indication of a problem with the air cleaner to alert a user of the problem.

What is claimed is:

1. An electrostatic air cleaner comprising:

an ionizing panel having at least one ionizing wire in connection with a voltage source, the ionizing panel being releasably received within the air cleaner in such a manner that an electrical connection is established between the at least one ionizing wire and the voltage source;

a collector cell having one or more collector plates, the cell being separate from the ionizing wire panel and being releasably received within the air cleaner in such a manner that an electrical connection is established between the one or more collector plates and the voltage source to permit application of a voltage potential between the one or more collector plates and the at least one ionizing wires;

a light source;

a screen for covering the light source, said screen being translucent to permit at least a portion of the light emitted by the light source to pass through the screen, said screen including indicia thereon through which light does not pass, wherein the indicia indicates the air cleaner requires cleaning; and a controller for connecting the voltage source to the ionizing circuit to initiate operation of the electrostatic air cleaner, the controller having a microprocessor for monitoring the number of times or on-cycles that the electrostatic air cleaner is operated, where the controller predicts a need for cleaning the one or more air cleaner cells upon reaching a predetermined number of on-cycles, and responsively activates the light source to illuminate the screen such that the indicia is visible for alerting a user that the air cleaner needs servicing.

2. The electrostatic air cleaner of claim 1 wherein the collector cell is releasably received within the air cleaner housing for allowing the removal of the cell to permit cleaning of the cell separately from the ionizing wire panel.

3. The electrostatic air cleaner of claim 1 wherein the indicia on the screen through which light does not pass through is only visible when the light source is activated once a predetermined number of cycles has transpired.

4. The electrostatic air cleaner of claim 1 wherein the indicia includes a contractor's contact information for requesting service of the air cleaner.

5. The electrostatic air cleaner of claim 1 wherein the indicia provides an indication of a problem with the air cleaner to alert a user of the problem.

6. The electrostatic air cleaner of claim 1 wherein the controller is configured to sense when there is a minimal voltage potential across the ionizing circuit that is indicative of a problem with the air cleaner, and to responsively activate the light source to illuminate the screen so as to illuminate indicia for indicating that there is a problem with the air cleaner.

7. An electrostatic air cleaner comprising:

an ionizing panel having at least one ionizing wire in connection with a voltage source, the ionizing panel being releasably received within the air cleaner housing in such a manner that an electrical connection is established between the at least one ionizing wire and the voltage source;

a collector cell having one or more collector plates, the cell being separate from the ionizing wire panel and being releasably received within the air cleaner housing in such a manner that an electrical connection is established between the one or more collector plates and the voltage source to permit application of a voltage potential between the one or more collector plates and the at least one ionizing wire; wherein the collector cell is releasably received within the air cleaner housing for allowing the removal of the cell to permit cleaning of the cell separately from the ionizing wire panels;

a light source;

a screen for covering the light source, said screen being translucent to permit at least a portion of the light emitted by the light source to pass through the screen, said screen including indicia thereon through which light does not pass, said indicia indicating there is a problem with the air cleaner; and a controller for connecting the voltage source to the ionizing circuit to initiate operation of the electrostatic air cleaner, the controller is configured to sense when there is a minimal voltage potential across the ionizing circuit that is indicative of a problem with the air cleaner, and to responsively activate the light source to illuminate the screen so as to illuminate indicia for indicating that there is a problem with the air cleaner.

8. The electrostatic air cleaner of claim 7 wherein the indicia on the screen through which light does not pass through is only visible when the light source is activated once a predetermined number of cycles has transpired.

9. The electrostatic air cleaner of claim 7 further comprising control means for monitoring the number of time the air cleaner has been operated, where upon reaching a predetermined number of cycles, the air cleaner activates the light source to illuminate the screen such that the indicia is visible.

10. The electrostatic air cleaner of claim 9 wherein the predetermined number of cycles is indicative of a need for cleaning of at least one collector cell.

11. The electrostatic air cleaner of claim 9 wherein the indicia further indicates the collector cell requires cleaning.

12. The electrostatic air cleaner of claim 9 wherein the indicia includes a contractor's contact information for requesting service of the air cleaner.

13. The electrostatic air cleaner of claim 9 wherein the indicia provides an indication of a problem with the air cleaner to alert a user of the problem.

14. An electrostatic air cleaner comprising:

an ionizing panel having at least one ionizing wire in connection with a voltage source, the ionizing panel being releasably received within the air cleaner housing in such a manner that an electrical connection is established between the at least one ionizing wire and the voltage source;

a collector cell having one or more collector plates, the cell being separate from the ionizing wire panel and being releasably received within the air cleaner housing in such a manner that an electrical connection is established between the one or more collector plates and the voltage source to permit application of a voltage potential between the one or more collector plates and the at least one ionizing wire;

a light source;

a screen for covering the light source that is translucent to permit at least a portion of the light emitted by the light source to pass through the screen, the screen including indicia through which light does not pass through, wherein the indicia for indicating the need for servicing indicates that at least one collector cell requires cleaning; and a controller for connecting the voltage source to the ionizing circuit to initiate operation of the electrostatic air cleaner, the controller including control means for monitoring the number of cycles of the air cleaner, where upon reaching a given percentage of a predetermined number of cycles indicative of a need for servicing, the air cleaner activates the light source to illuminate the screen such that the indicia is visible to alert a user of a need for servicing the air cleaner.

15. The electrostatic air cleaner of claim 14 wherein the collector cell is releasably received within the air cleaner housing for allowing the removal of the cell to permit cleaning of the cell separately from the ionizing wire panel.

16. The electrostatic air cleaner of claim 15 wherein the indicia includes a contractor's contact information for requesting service of the air cleaner.

17. The electrostatic air cleaner of claim 16 wherein the light source comprises electroluminescent lighting for illuminating the screen when an electrical voltage is applied to the electroluminescent lighting.

18. The electrostatic air cleaner of claim 17 wherein the air cleaner further includes indicia for providing an indication of a problem with the air cleaner to alert a user of a need for servicing of the problem.

19. The electrostatic air cleaner of claim 14 wherein the controller is configured to sense when there is a minimal voltage potential across the ionizing circuit that is indicative of a problem with the air cleaner, and to responsively activate the light source to illuminate the screen so as to illuminate indicia for indicating that there is a problem with the air cleaner.

* * * * *